United States Patent [19]

Sauer

[11] 4,375,580

[45] Mar. 1, 1983

[54] AM STEREO RECEIVER SEPARATION CONTROL

[75] Inventor: Don R. Sauer, San Jose, Calif.

[73] Assignee: National Semiconductor Corporation, Santa Clara, Calif.

[21] Appl. No.: 200,636

[22] Filed: Oct. 27, 1980

[51] Int. Cl.[3] ..... H04H 5/00

[52] U.S. Cl. ..... 179/1 GS

[58] Field of Search ..... 179/1 GS; 370/61; 455/214

[56] References Cited

U.S. PATENT DOCUMENTS

| | | | |
|---|---|---|---|
| 3,076,057 | 1/1963 | Baugh, Jr. | 179/1 GS |
| 3,128,345 | 4/1964 | Freedman et al. | 179/1 GS |
| 4,302,626 | 11/1981 | Streeter | 179/1 GS |

*Primary Examiner*—R. J. Hickey

*Attorney, Agent, or Firm*—Gail W. Woodward; Paul J. Winters; Neil B. Schulte

[57] ABSTRACT

In AM radio receivers it is desirable to operate the automatic gain control so that strong signals are actually heard louder than weaker signals. This means that when AM stereo is incorporated into the radio, using a limiter and phase demodulator to recover the L−R stereo information, some means must be provided to cope with the variable L+R signal level. Typically this is done by using a gain control characteristic that eliminates the desired variable sound level. In the invention an absolute value detector is employed as an AM demodulator, the d-c output of which is related to the L+R signal content. A multiplier is coupled between the phase demodulator L−R output and the matrix in which the L+R and L−R signals are combined to produce the separate L and R signals. The multiplier is biased by the d-c component at the AM detector. Thus, as the L+R level varies, the L−R out of multiplier is varied to match. Additionally, the multiplier is provided with an electronic control port which can act to reduce the L−R signal below optimum, thereby producing stereo blend.

6 Claims, 2 Drawing Figures

AM STEREO RECEIVER SEPARATION CONTROL

BACKGROUND OF THE INVENTION

The invention relates to AM stereo radio broadcast receivers and is particularly directed to a receiver using the Magnavox system recently announced as one of the systems of choice by the Federal Communications Commission In this system, the conventional amplitude modulated (AM) radio channel carries the L+R stereo signal so that a conventional monaural radio receives a compatible signal. The L−R stereo signal is transmitted as a phase modulation (PM) of the carrier. A subaudible pilot tone also phase modulates the carrier and its phase modulation is subsantially greate than of the L−R component. Since the conventional radio will not respond to the PM, it will not be affected thereby. However, if a limiter and PM detector are added to a conventional radio, the AM will be ignored in the added circuit and the PM can be recovered. Therefore the L−R information and pilot signal can be separately recovered. It is then only necessary to matrix the two channels to recover the stereo signals for reproduction in a stereo audio system. While the circuits disclosed herein are intended for use with the proposed Magnavox system, it is to be understood that the functions performed can be used with other proposed AM stereo systems.

My copending patent application Ser. No. 197,294 filed Oct. 15, 1980, is titled AM STEREO PHASE MODULATION DECODER and is assigned to the assignee of the present invention. A PM decoder is disclosed for use with the Magnavox system receiver.

My copending patent application Ser. No. 187,006 filed Sept. 15, 1980, is titled FULL WAVE AMPLITUDE MODULATION DETECTOR CIRCUIT and is assigned to the assignee of the present invention. It discloses a detector circuit primarily intended for use in AM stereo receivers and it has application to the present invention as will be described hereinafter.

Both of the above applications are incorporated herein by reference.

In conventional radio receiver design it has been found that a "tight" automatic gain control (AGC) will produce the same output signal for virtually all stations. This means that the user cannot distinguish a strong station from a weak one merely by listening. It is common practice to provide an AGC characteristic that will provide reasonably constant output but is "loose" enough to cause strong signals to sound louder than the weak ones. In an AM stereo receiver this means that the L+R signal level is variable. Since the L−R signal from the phase demodulator is constant, due to limiter action, these two signals are difficult to matrix. In most AM stereo receiver designs a "tight" AGC is employed so that the L+R signal is relatively constant. This means that the desired tuning characteristic is lost.

SUMMARY OF THE INVENTION

It is an object of the invention to vary the L−R signal level in an AM stereo receiver to match the level of the L+R signal.

It is a further object of the invention to provide an AGC characteristics in an AM stereo receiver that gives an output which is related to the signal strength and to vary the L−R signal level so that it tracks the L+R signal level.

It is a still further object of the invention to couple the L−R signal in an AM stereo receiver through a multiplier circuit which is also fed a d-c signal that is related to the L+R level.

It is still further object of the invention to employ an absolute value detector in the L+R channel of an AM stereo receiver to produce a d-c signal directly related to the L+R signal level and to use the d-c signal to vary the gain of a multiplier coupled between the receiver phase demodulator and the matrix circuit.

It is a still further object of the invention to provide an electronic blend control in an AM stereo receiver by varying the level of the L−R signal relative to that of the L+R signal.

These and other objects are achieved using the following configuration. In an AM stereo receiver the L+R channel, which represents the compatible monaural signal channel, is provided with an absolute value detector circuit. This means that the L+R signal is accompanied by a proportional d-c signal. This d-c signal can be used in the receiver AGC circuit. The L−R signal channel is provided with a phase demodulator, the output of which drives a multiplier of balanced construction. The gain of the multiplier is varied with the d-c signal. This means that as the L+R signal varies, the L−R level tracks it. When the two channels are matrixed the resultant L and R signals are adequately separated even though the level of the L+R signal varies from station to station. In a preferred embodiment the multiplier circuit further includes a blend control which acts to reduce the L−R signal level relative to the L+R signal.

DESCRIPTION OF THE INVENTION

Figure 1:
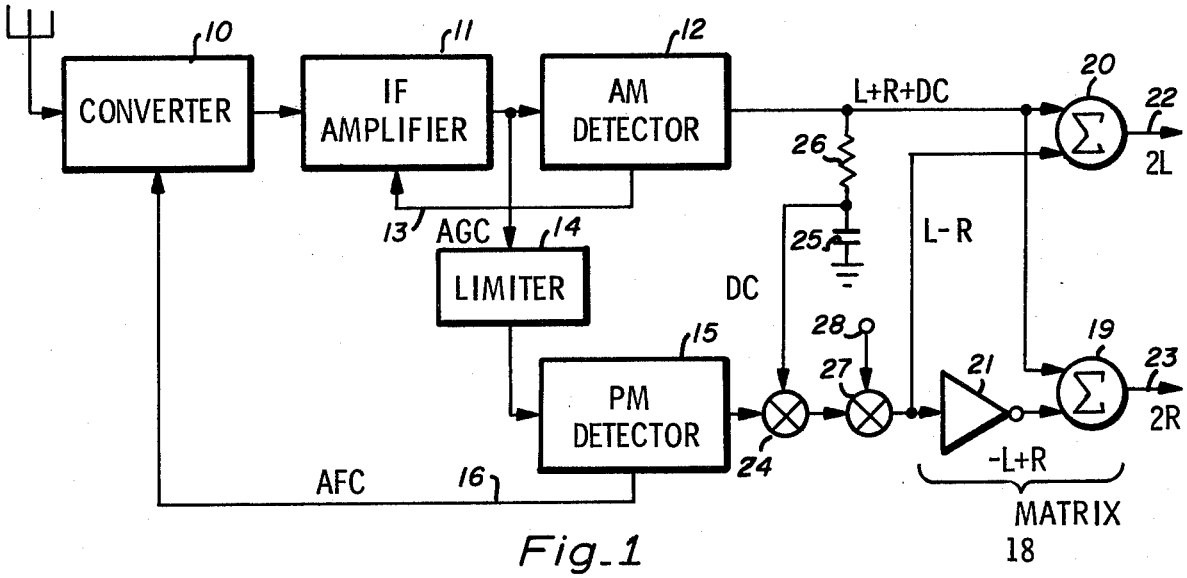
FIG. 1 is a block diagram of an AM stereo receiver employing the invention.

FIG. 1 is a block diagram of an AM stereo receiver. Converter 10, I-F amplifier 11 and detector 12 comprise the stereo L+R channel. Detector 12 provides AGC action via line 13. Desirably the AGC is made "loose" so that stronger stations produce a discernibly louder signal than the weaker stations. While not shown, the receiver could include an R-F amplifier. These elements made up a conventional AM receiver which, using the proposed Magnavox system, would operate compatibly in that it would be unaware of the presence of the stereo operation.

The I-F amplifier 11 also drives limiter 14 which feeds PM detector 15 to produce the L−R stereo information. The two stereo channels are fed to a matrix circuit 18. Matrix 18 is conventional but will be detailed for a full understanding of the invention. Two summers 19 and 20 are used along with inverter 21. The L+R and L−R signals when summed in 20 produce a 2L output on line 22. The L−R signal is inverted to produce—L+R which is summed at 19 with L+R to produce a 2R output on line 23. While not shown, lines 22 and 23 would be coupled to a conventional stereo amplifier and speaker system to produce stereo sound. If desired, the receiver can employ automatic frequency control by coupling a control signal via line 16 to converter 10.

The heart of the invention is in multiplier 24 which is driven with the L−R signal from PM detector 15. Multiplier 24 is also supplied with a d-c signal from detector 12. Capacitor 25 and resistor 26 provide a low pass filter d-c transmission path. Multiplier 27 is in cascade with multiplier 24. Blend terminal 28 represents a d-c input to multiplier 27 for varying its transfer function. Under normal conditions the signal at blend terminal is set for maximum transfer in multiplier 27. Then the circuit components are adjusted so that the L+R and L−R signals coupled to matrix 18 are equal. For this condition the L and R signals at lines 22 and 23 display maximum stereo separation.

When the signal at blend terminal 28 is adjusted to lower the signal transfer through multiplier 27, the L−R signal is reduced. If there were no L−R signal at all, the output terminals 22 and 23 would both reproduce the L+R or mono signal. Thus blend terminal 28 permits the deliberate reduction of stereo separation in response to a d-c voltage.

If AM detector 12 is linear, the d-c voltage coupled to multiplier 24 will track the L+R signal magnitude and produce an equal value L−R signal at matrix 18. Desirably, the AM detector circuit 12 is the one disclosed in my copending application Ser. No. 187,006 filed Sept. 15, 1980. The PM detector is desirably the circuit disclosed in my copending application Ser. No. 197,294 filed Oct. 15, 1980.

Figure 2:
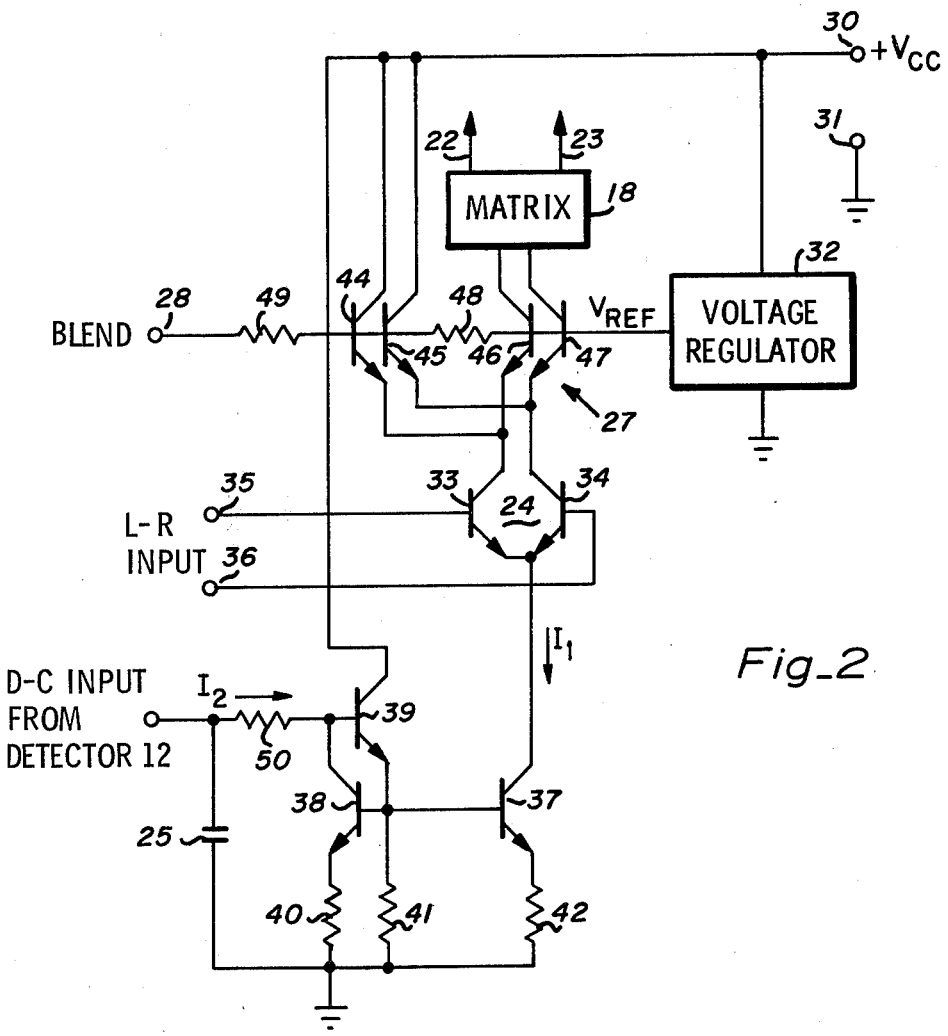
FIG. 2 is a schematic diagram of the multiplier circuit shown in block form in FIG. 1.

FIG. 2 illustrates, in schematic diagram form, the circuitry associated with multipliers 24 and 27. An operating power supply is connected between $+V_{cc}$ terminal 30 and ground terminal 31. A conventional voltage regulator 32 provides a regulated $V_{REF}$.

Multiplier 24 comprises transistors 33 and 34 differentially driven at terminals 35 and 36 by the L−R signal available from PM detector 15. The tail current, $I_1$, is supplied by transistor 37 which along with transistors 38 and 39 comprise a current mirror to reflect $I_2$ the d-c output of detector 12. Resistors 40, 41 and 42 act to distribute the current mirror currents. If transistors 37 and 38 are made the same size and if resistors 40 and 42 are the same value, $I_1$, will equal $I_2$.

Transistors 44 through 47 comprise multiplier 27. It will be noted that transistors 33 and 34 have their collectors coupled to emitter loads formed by transistors 44-47. The collection of transistors 46 and 47 couple to matrix 18 which provides the load elements for multiplier 27. The bases of transistors 46 and 47 are constant voltage biased at $V_{REF}$. Assuming that blend terminal 28 is open circuited, the bases of transistors 44-47 will all be at $V_{REF}$ and equally conductive. Their total combined conduction will equal $I_1$.

If blend terminal 28 is grounded, resistors 48 and 49, acting as a voltage divider, will pull the bases of transistors 44 and 45 below the bases of transistors 46 and 47. For this condition virtually all of $I_1$ will flow in transistors 46 and 47 and the gain of multiplier 27 is maximum. If blend terminal 28 is returned to +V at terminal 30, the bases of transistors 44 and 45 will be pulled higher than the bases of transistors 46 and 47. For this condition virtually all of $I_1$ will flow in transistors 44 and 45 and the gain of multiplier 27 is minimum. Thus the d-c voltage at terminal 28 can be used to vary the L−R signal level out of multiplier 27 so that electronic blend, or L and R mixing, of the stereo signals is available. Normally when blend terminal 28 is grounded the circuit components are valued to make L+R equal to L−R.

EXAMPLE

The circuit of FIG. 2 was fabricated in integrated circuit form using conventional monolithic integrated circuit construction. The transistors were all of NPN vertical construction having current gain values in excess of 200.

The following component values were used.

| Part | Value | Units |
|---|---|---|
| *Capacitor 25 | 10 | microfarads |
| resistor 40 | 1K | ohms |
| resistor 41 | 5K | ohms |
| resistor 42 | 1K | ohms |
| resistor 48 | 5K | ohms |
| resistor 49 | 50K | ohms |
| resistor 50 | 8K | ohms |

*External to IC

The circuit was operated from an 8-volt $V_{cc}$ supply and regulator 32 produced a 4.2 volt $V_{REF}$. With blend terminal 28 grounded, the stereo separation was better than 30 db even though both strong and weak station signals were simulated. With blend terminal 28 returned to the $+V_{cc}$ terminal, the outputs at terminals 22 and 23 were both substantially L+R. The voltage at the bases of transistors 44 and 45 varied from 0.38 volt below that of transistors 46 and 47 to 0.35 volt higher depending upon whether blend control was grounded or at $+V_{cc}$.

The invention has been described and a working example given. When a person skilled in that art reads the foregoing, alternatives and equivalents within the spirit and intent of the invention will occur to him. Accordingly, it is intended that the scope of the invention be limited only by the following claims.

I claim:

1. An AM stereo radio receiver in which L+R signal information is transmitted via conventional amplitude modulation of a carrier signal and L−R signal information is transmitted via phase modulation of said carrier, said receiver comprising:

a matrix circuit for combining said L+R and L−R information to create L and R stereo signals;

an amplitude modulation detector for producing said L+R signal along with a d-c component related to the average value of said L+R carrier;

a phase modulation detector for producing said L−R signal;

a first multiplier circuit having first and second inputs and an output coupled to said matrix circuit;

means for coupling said first input of said first multiplier to said phase modulation detector;

means for coupling said second input of said first multiplier to receive said d-c component from said amplitude modulation detector whereby said L−R signal out of said first multiplier is varied in amplitude so to track the amplitude of said L+R signal at said amplitude modulation detector;

a second multiplier circuit coupled in cascade with said first multiplier circuit; and means for varying the signal transfer of said second multiplier whereby the amplitude of said L−R signal can be varied relative to said L+R signal to create blending of said L and R signals.

2. The receiver of claim 1 wherein said first multiplier comprises a pair of differentially connected transistors the bases of which are coupled to said phase modulation detector to receive said L−R signal.

3. The receiver of claim 2 wherein said first multiplier further comprises a current mirror coupled to supply the tail current in response to said d-c component from said amplitude modulation detector.

4. The receiver of claim 3 wherein said differentially connected transistors have their collectors coupled to the emitters of additional transistors which act as load elements therefore.

5. The receiver of claim 4 wherein said additional transistors act as coupling means between said pair of differentially connected transistors and said matrix circuit.

6. The receiver of claim 5 wherein said additional transistors comprise a second multiplier, the biasing of which controls the blending of said L and R stereo signals.

* * * * *